United States Patent [19]

Caple

[11] Patent Number: 4,796,658

[45] Date of Patent: Jan. 10, 1989

[54] APPARATUS FOR DETECTING BASEMENT WATER

[76] Inventor: Roderick Caple, 916 Canford Cres., S.W., Calgary, Alberta, Canada, T2W 1L2

[21] Appl. No.: 68,385

[22] Filed: Jul. 1, 1987

[30] Foreign Application Priority Data

Jul. 24, 1986 [CA] Canada ..... 514610

[51] Int. Cl.[4] ..... F16K 31/02; H01H 29/04

[52] U.S. Cl. ..... 137/312; 73/304 R; 73/313; 137/392; 137/558; 200/61.04; 307/118; 340/604; 340/605; 340/620; 361/178

[58] Field of Search ..... 73/40, 40.5 R, 40.7, 73/304 R, 313; 137/236.1, 312, 392, 558; 200/61.04, 61.05; 307/118; 340/604, 605, 620; 361/178

[56] References Cited

U.S. PATENT DOCUMENTS

| | | | |
|---|---|---|---|
| 2,347,544 | 4/1944 | DeCosta et al. | 137/392 |
| 2,735,907 | 2/1956 | Inman | 200/61.05 |
| 3,311,722 | 3/1967 | Hammerschmidt et al. | 340/604 |
| 3,399,399 | 8/1968 | Apfelbaum | 340/620 |
| 3,564,527 | 2/1971 | Lerner et al. | 340/605 |
| 3,757,316 | 9/1973 | Fiorenzo | 340/620 |
| 3,770,002 | 11/1973 | Brown | 137/312 |
| 4,305,420 | 12/1981 | Nussdorf | 137/392 |
| 4,392,128 | 7/1983 | Young et al. | 340/620 |
| 4,417,598 | 11/1983 | DePirro | 200/61.05 |
| 4,541,446 | 9/1985 | Hogan | 137/392 |

*Primary Examiner*—George L. Walton
*Attorney, Agent, or Firm*—George H. Dunsmuir; William R. Hinds

[57] ABSTRACT

Basement flooding due inter alia, to drain overflow or sump pump failure is a common problem. An apparatus for solving the problem includes a cover for closing a basement floor drain, a tubular casing extending through the cover into the drain, a pair of spaced apart conductors in the casing for completing an electrical circuit when water rises through the open bottom end of the casing to a predetermined level, and a control circuit connected to the conductors and to a solenoid valve in the building water supply pipe for closing the latter, so that no additional water enters the drain to exacerbate an already bad condition. A second pair of spaced apart conductors on the floor of the basement is coupled to the control circuit to give the same response in the presence of floor moisture. An audible alarm is sounded as part of the response to detected water.

15 Claims, 4 Drawing Sheets

APPARATUS FOR DETECTING BASEMENT WATER

BACKGROUND OF THE INVENTION

This invention relates to an apparatus for detecting the presence of liquid, and in particular to an apparatus for detecting the liquid level in the basement floor drain of a building.

The problem of water and/or sewage in the basements of urban dwellings is both common and chronic. The problem arises for a variety of reasons, including sewer backup, sump pump failure and leaking appliances. The inventor is aware of no commercially available devices for dealing with the problem of basement flooding.

A search of the patent literature reveals a variety of fluid level detectors or indicators. Examples of such devices are found in Canadian Pat. Nos. 860,520, which issued to J. Lerner et al on Jan. 5, 1971, 993,538, which issued to H. L. Schneider on July 20, 1976, 1,068,373, which issued to W. G. Lolber on Dec. 18, 1979 and 1,074,055, which issued to R. L. Ringler on Mar. 25, 1980. The devices disclosed by these patents are unsuitable for use in a basement, and offer no solution to the problem of floor drain overflow.

SUMMARY OF THE INVENTION

The object of the present invention is to solve the problems set out above by providing a relatively simple apparatus for detecting the liquid level in the basement floor drain of a building or the presence of water on the floor and responding to either by shutting off the water supply, which substantially reduces the likelihood of basement flooding.

In accordance with the invention, in a building having a below-grade basement floor, a floor drain in the basement floor leading to an exterior waste water disposal means, and a water supply line for supplying water to the building, there is provided apparatus for detecting the liquid level in the basement floor drain of the building comprising cover means closing the top of the drain; tubular casing means extending through said cover means into the drain, said casing means having an open bottom end for admitting liquid when the liquid level in the drain rises above a predetermined level; first sensor means extending downwardly into said casing means for contacting by the liquid upon rising above such predetermined level; a drain vent line connected at one end with the cover means and communicating with the upper part of the drain and leading therefrom to communicate with the atmosphere at a location above grade of the building for allowing any air above the rising liquid level to escape via said drain vent line, said location above grade of the building being such that waste water overflow from said waste water disposal means can occur outside the building before the liquid level in the said drain vent line reaches the upper end of said drain vent line at said location; and control means connected to said sensor means for shutting off the water supply to the building when the liquid level rises above said predetermined level.

Also in accordance with the invention, in a building having a below-grade basement floor, a floor drain in the basement floor leading to an exterior waste water disposal means, and a water supply line for supplying water to the building, there is provided apparatus for detecting liquid in the basement of the building comprising cover means for closing the top of the floor drain; tubular casing means for extending through said cover means into said drain, said casing means having an open bottom end for admitting liquid when the liquid level in the drain rises above a predetermined level, first sensor means extending downwardly into said casing means for contacting by the liquid upon rising above said predetermined level; a drain vent line connected at one end with the cover means and communicating with the upper part of the drain and leading therefrom to communicate with the atmosphere at a location above grade of the building for allowing any trapped air above the rising liquid level to escape via said drain vent line, said location above grade of the building being such that waste water overflow from said waste water disposal means can occur outside the building before the liquid level in said drain vent line reaches the upper end of said drain vent line at said location; second sensor means for placing on the basement floor for detecting moisture on the floor; control means connected to said first and second sensor means for shutting off the water supply to the building when the liquid level rises above said predetermined level or when said second sensor means senses moisture on the floor.

Still further in accordance with the invention, in a building having a below-grade basement floor, a floor drain in the basement floor leading to an exterior waste water disposal means, a generally U-shaped trap disposed below said floor drain, and a water supply line for supplying water to the building, there is provided apparatus for monitoring the liquid level in the basement floor drain of the building comprising cover means for closing the top of the drain, a tubular casing extending through the cover means into the drain, said tubular casing having means for venting any trapped air above the rising liquid level, said tubular casing having an open lower end for admitting liquid, first sensor means extending downwardly into said casing to a predetermined level above said U-shaped trap so as to be contacted by liquid upon rising in said casing to said predetermined level, said casing further including an open ended extension member extending downwardly in the drain beyond the low point of said trap such that the lower inlet end of the casing is above the low point of said trap to minimize the possibility of bubbles entering said open end and forming a foam in said casing which might give a false signal to said sensor means, and control means connected to said sensor means for shutting off the water supply to the building when the liquid level rises above said predetermined level.

BRIEF DESCRIPTION OF THE DRAWING

The invention will now be described in greater detail with reference to the accompanying drawings, which illustrate a preferred embodiment of the invention, and wherein.

DESCRIPTION OF THE PREFERRED EMBODIMENTS

Figure 2:
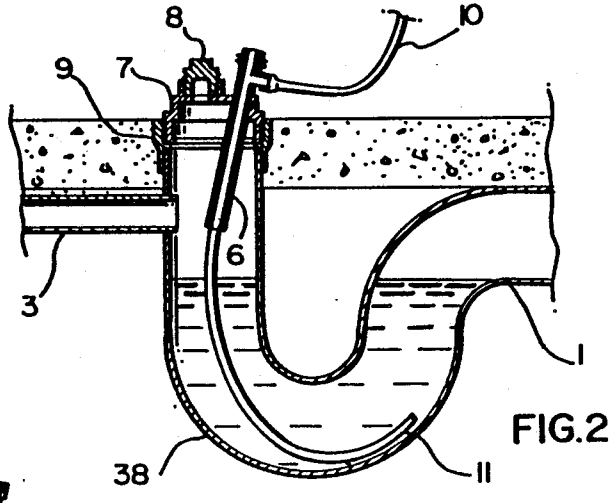
FIG. 2 is a schematic cross section of portions of the floor drain and apparatus of FIG. 1 on a larger scale.
Figure 1:
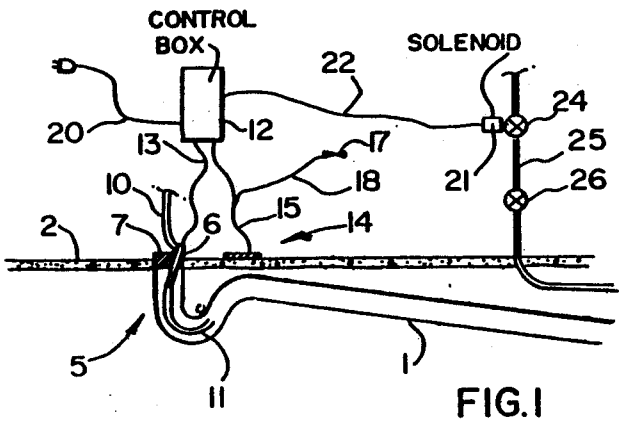
FIG. 1 is schematic cross section of a basement floor drain incorporating an apparatus in accordance with the present invention.
Figure 3:
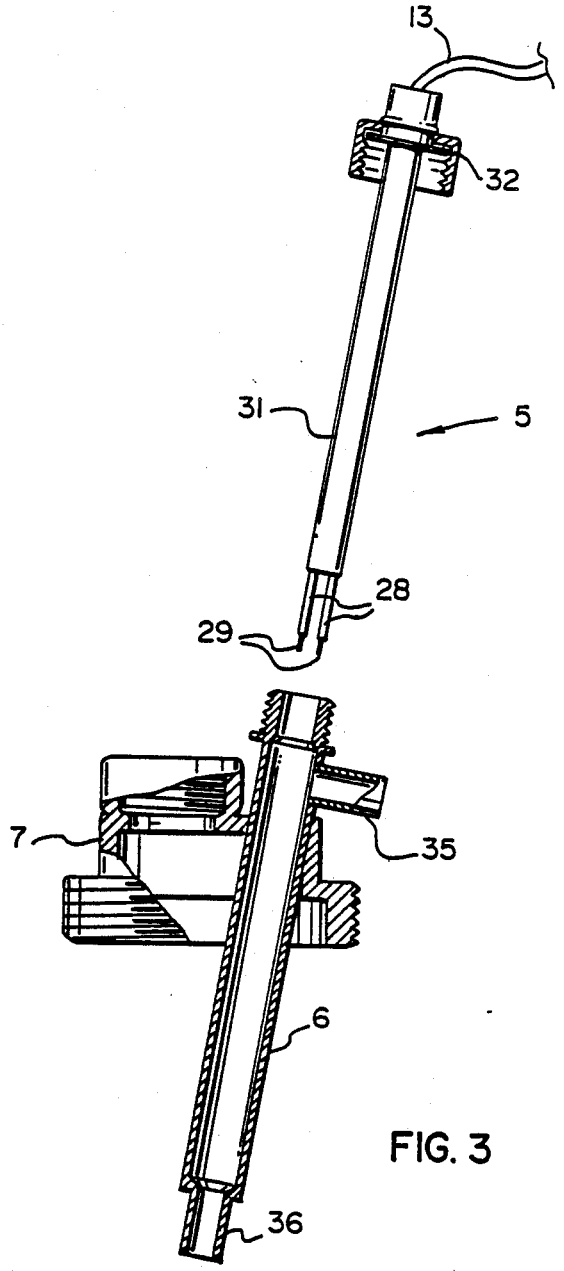
FIG. 3, which appears on the second sheet of drawings, is an exploded cross-sectional view of a portion of the apparatus of FIGS. 1 and 2.

Referring to FIGS. 1 to 3, the apparatus of the present invention is intended for use in a floor drain pipe 1 in a basement floor 2. A washer discharge pipe 3 (FIG. 2) may be connected to the drain pipe 1 below the floor 2. The apparatus includes a first sensor generally indicated at 5 (FIGS. 1 and 3) which normally extends downwardly into a casing 6 in a floor drain plug 7. A removable cap 8 is provided in the plug 7, so that the floor drain can be used as a drain, or to accept water waste such as surplus water from a humidifier (not shown). The bottom end of the plug 7 is externally threaded for mounting in a floor sleeve 9. A vent tube 10 is attached to the top end of the casing 6 and an extension tube 11 is attached to the bottom end thereof. The sensor 5 is connected to a control box 12 by an electrical wire 13.

A second, floorsensor generally indicated at 14 is mounted on the floor 2 for detecting the presence of floor moisture. The sensor 14 is connected to the control box 12 by a wire 15. Other floor sensors, indicated schematically at 17, can also be connected to the box 12 by wires (one shown). The control box 12 is connected to a wall plug (not shown) by a lead 20, and to a solenoid 21 by a lead 22. The solenoid 21 operates a valve 24 in the water inlet main 25 of the building. The main 25 also contains the usual manually operated valve 26. The sensor 5 is defined by a pair of spaced apart conductors 28 connected to the wire 13. The bottom ends 29 of the conductors 28 are free of insulation, so that water rising in the casing 6 will close a circuit between such ends. The conductors 28 are mounted in a sleeve 31, the top end of which is connected to an internally threaded cap 32. The cap 32 is connected to the externally threaded top end of the casing 6, so that the conductors 28 extend downwardly to near the bottom end of the casing 6. A rubber washer (not shown), inside the cap 32, forms a seal at the top of the casing 6. An outlet duct 35 near the top end of the casing 6 is used to connect the latter to the vent tube 10. The vent tube 10 extends up to or above the grade level outside the building which ensures that sewer overflow outside the building will occur before the liquid level reaches the upper end of the vent tube 10. In order to achieve full advantage of the system, all below grade fixtures should be protected by back flow preventing valves. A reduced diameter portion 36 at the bottom end of the casing receives the extension tube 11. The tube 11 extends downwardly in the drain pipe 1 beyond the low point of the trap 38 thereof. Thus, the inlet end of the tube 11 is above such low point which prevents bubbles entering the tube and forming a foam in the casing 6. The presence of foam in the casing 6 could result in triggering of the sensor 5 even though the liquid level in the pipe 1 is not sufficiently high to contact the conductors 28.

Figure 5:
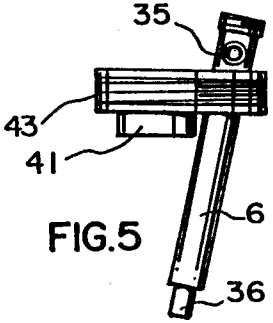
FIGS. 4 and 5 are side elevation views of two different types of floor drain plugs for use in the apparatus of FIGS. 1 to 3.
Figure 4:
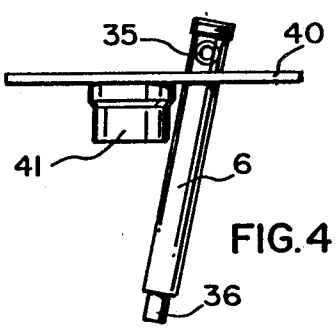

Alternate forms of floor drain plugs are shown in FIGS. 4 and 5. One form (FIG. 4) includes a plate 40 for flush mounting on or in the floor 2 and held down by bolts (not shown), with sleeve 41 for extending downwardly into the drain pipe 1. The sleeve 41 receives a cap (not shown) in its open top end. Another plug (FIG. 5) includes an externally threaded, cylindrical body 43. The remaining elements of the plugs are the same as the plug of FIGS. 2 and 3, and consequently the same reference numerals are used to identify the same or similar elements.

Figure 6:
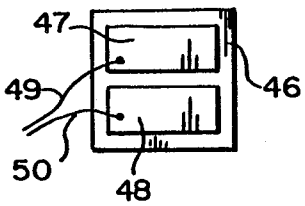
FIG. 6 is a schematic plan view of a floor moisture sensor used in the apparatus of FIG. 1.

With reference to FIG. 6, the second or floor sensor 14 includes a non-conductive baseplate 46 formed of circuit board material, which is etched to leave two separate, spaced apart copper surface areas 47 and 48. Electrical leads 49 and 50 are connected to the areas 47 and 48, respectively. Water on the surface of the sensor 14 completes a circuit between the areas 47 and 48, and consequently between the wires 49 and 50 to trigger an alarm. The baseplate 46 is glued to the floor 2 near the plug 7. Other low points where the accumulation of moisture is likely can be protected by additional sensors 17 (FIG. 1).

Figure 7:
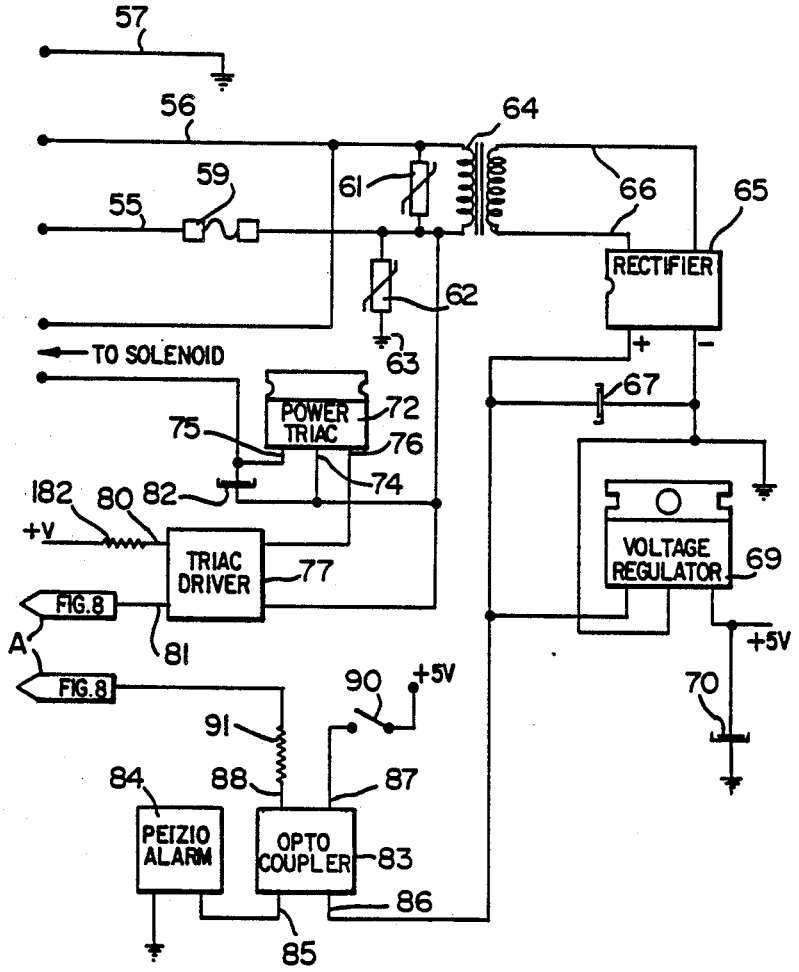
FIGS. 7 and 8 are schematic, block circuit diagrams of the control circuit used in the apparatus of FIG. 1.
Figure 8:
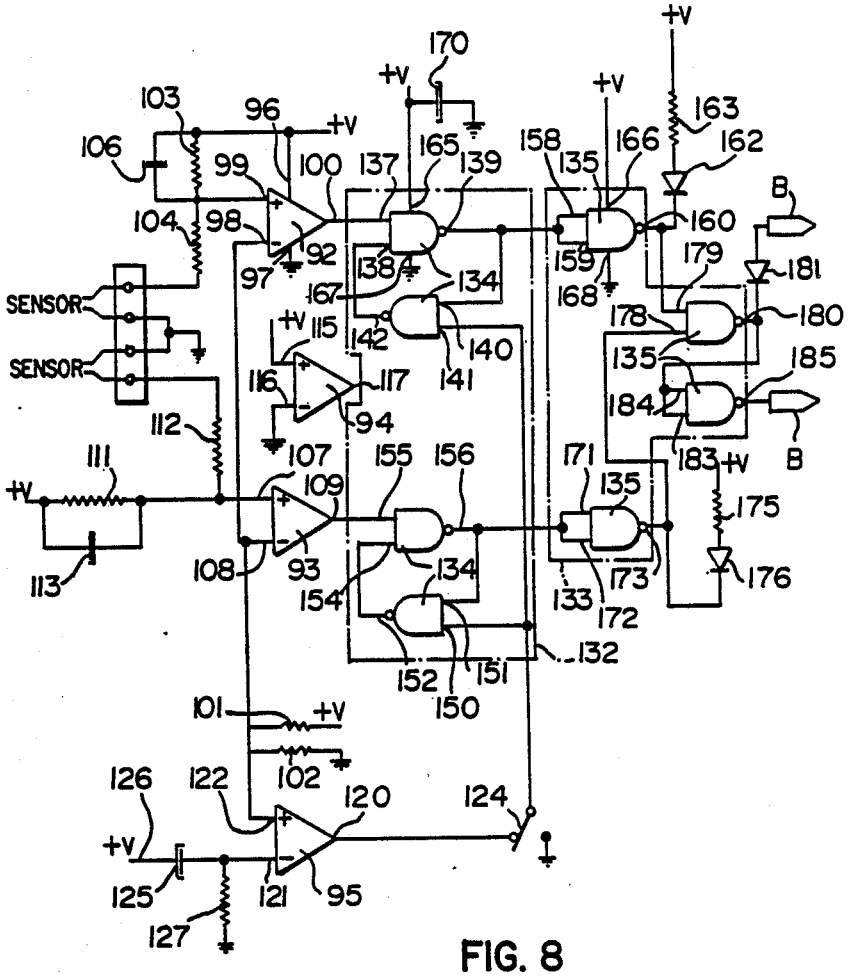

The control circuit housed in the control box 12 will be described with reference to FIGS. 7 and 8. The arrows A in FIG. 7 and B in FIG. 8 represent the connection between the circuits of FIGS. 7 and 8. FIG. 7 shows the power supply for the sensing and logic circuits, and the switching to control alarm and solenoid valve functions.

Referring to FIG. 7, power is supplied to the control using a grounded power cord 20 (FIG. 1) defined by lines 55, 56 and 57, so that live and neutral lines or sides 55 and 56 of the supply are distinguished. The live side 55 is taken through a one Amp. fuse 59. A pair of metal oxide varistor devices 61 and 62 are provided on the fused side of the circuit. The varistor devices 61 and 62 conduct during voltage spikes and substantially avoid spurious alarm responses due to line noise. The varistor devices 61 and 62 also protect other components in the circuit from damage.

A transformer 64 between the live and neutral lines 55 and 56 reduces the nominal 110 volt supply to 12.6 vilts. The output of the transformer 64 supplies a full wave rectifier 65 via lines 66. An electrolytic capacitor 67 provides storage for supply current when the output of the rectifier is less than the desired level, which is usual in rectified power supplies. A voltage regulator 69 (of the type 7805) supplies a regulated 5 volt output from the approximately 18 volt dc input across the capacitor 67. A capacitor 70 on the regulated side smoothes the switching spikes of the regulator 69, and is usual feature of a circuit using the 7805 type regulator.

A power triac 72 is used to control the solenoid valve 21. The fused supply is connected to lead 74 of the triac 72, and lead 75 of the triac is connected to one side of the solenoid 21. Thus, between leads 74 and 75 the triac provides the effect of a switch, controlled by the state of a third lead 76, which is the trigger. When the lead 76 is connected to the lead 75, the switch is on and when the two leads are disconnected the switch is off. This action is controlled by an optically-coupled triac drive 77 defined by an integrated circuit (an MOC 3010), which uses light from an internal light emitting diode between leads 80 and 81 to trigger an internal triac. The net effect is that a current flowing from the lead 80 to the lead 81 through the triac 77 causes voltage to be applied to the coil (not shown) of the solenoid 21 controlling the valve 24. A capacitor 82 suppresses transient voltages which can prevent the power triac 72 from turning off when the trigger circuit is opened.

An optocoupler 83 (defined by a TIL 119 integrated circuit) is used to control the audible piezo alarm 84. The optocoupler 83 uses a Darlington coupled pair of transistors to control the flow of current between leads 85 and 86. Output current depends upon input current from leads 87 and 88. The current flows through an internal light emitting diode. The light intensity controls current in the Darlington coupled output transistors. The net result is that the current flow from lead 87 to lead 88 causes the alarm 84 to sound. A switch 90 provides the option of manually selecting the alarm function. A resistor 91 serves to limit current to a level acceptable to the devices.

FIG. 8 illustrates the sensor amplification and logic circuitry. The amplifier is an industry device #LN324N which contains four operational amplifier circuits in a dual in-line package with fourteen leads. Each of the four operational amplifiers 92, 93, 94 and 95 is shown separately in FIG. 8 using the usual notation of a triangle. The amplifier output is the apex with a connection, while the inputs are shown entering the side opposite to the output. The inputs require only minute voltage changes to product large voltage changes at the output. The inputs also require only minute current drains. When the voltage at the input marked "+" is significantly above the marked "−" the output approaches the supply voltage. When the voltage at the input marked "+" is at or below the voltage of the lead marked "−" the output approaches zero. The power supply to the integrated circuit device is connected through a lead 96 (positive supply) and a lead 97 (ground). This is shown as only one of the four amplifier symbols.

The operational amplifier 93 having inputs 98 and 99 and input 100 is used as one of the two sensor amplifiers. The input 98 is connected to the centre of a pair of voltage dividing resistors 101 and 102, so that its potential is held at approximately 2.5 volts. The input 98 is connected to the centre of another voltage divider defined by a resistor 103 (about 50k Ohm) and a resistor 104 (about 1.0k Ohm) plus the resistance of the sensor to ground. When the resistance across the sensor is greater than about 50k Ohms, potential at the input 99 is above 2.5 volts and the output 100 is close to 5 volts. When the sensor resistance is significantly less than 50k Ohms the potential at the input 99 is below that of the input 98, and the output approaches zero volts.

The combination of the resistor 103,104 and a capacitor 106 slow the time response, and thus avoid rapid switching which might cause chattering of the solenoid valve 25 which could cause water hammer and loud noise in the building. A change in the potential difference across the capacitor 106 requires current flow in the resistors 103 or 104. The circuit values are chosen to provide an approximately one-half second delay on opening a shorted sensor.

The amplifier 93, the resistors 111 and 112 and the capacitor 113 are used in the amplifier circuit for the other of the sensors. The second amplifier circuit performs in a manner similar to the above described first circuit.

The pin 115 of the amplifier 94 (which is unused) is connected to the 5 volt supply, and the input 13 is connected to ground which causes the output 117 to approach 5 volts. This is done to prevent unwanted oscillation which might occur if the inputs were left unconnected, and to place the device in a state which minimizes power demand.

The operational amplifier 95 is used in a time delay circuit which forces a logic reset at power-up or following a power failure. With a switch 124 in the latch position as shown in FIG. 8, a fault condition once detected will be locked in even if the fault (i.e. low resistance) is cleared at the sensor. Such a logic reset is accomplished through the charging delay of a capacitor 125. As the voltage at point 126 rises on power-up, virtually all of the drop appears across the resistor 127 which holds the input 121 at a potential above the 2.5 volt potential of the input 122 (from the centre of the voltage dividing pair of resistors 101 and 102). The output of the amplifier is consequently held low, forcing a reset, even if the switch 124 is in the latch condition. As the capacitor 125 charges by current flow through the resistor 127, the potential at the pin 121 falls. When the potential falls below 2.5 volts, the output of the amplifier approaches the 5 volt supply and the latching condition is obtained.

Integrated circuits 132 and 133 of FIG. 8 are both transistor-transistor logic (TTL) 14 pin packages (industry device number 7400). Each circuit contains four separate negative-and (NAND) gates 134 and 135. The gates 134 and 135 perform a logical "and" on the two inputs, and ouput the negative of such result. In other words, if both inputs are "high" the output is "low", while for all other input combinations the output is "high". "High" and "low" describe the potential at an input or output.

The NAND gates are shown with the usual D-shaped symbol, the two inputs being on the flat side and the output on the curved side. A small circle at the output indicates negation.

The two NAND gates having outputs 139 and 142 provide a logical latch for one of the amplified sensor circuits. When a fault (i.e. moisture) is detected by the upper sensor in FIG. 8, the output 98 of the amplifier 93 goes low which forces the input 137 low and causes output 139 to go high, regardless of the state of the input 138. If the switch 124 is in the latch position, inputs 140 and 141 will both be high (because of the connections between output 139 and input 140 and from input 141 to the switch 124), causing the output 142 to be held low. The output 142 is connected to input 138, holding the latter low and consequently holding the output 139 high regardless of the state of the input 137 which creates a latched condition for the state of output 139.

If the switch 124 is placed in the reset position (to the right in FIG. 8), the input 141 is held low which forces the output 142 and the input 138 to be held high regardless of the state of output 139 and input 140. As a result, the output 139 is simply the inverse of the input 137 as long as the switch 124 is in the reset position.

The gates corresponding to the outputs 152 and 156 perform the same latching function for the second sensor.

The gate corresponding to the output 160 performs the function of a logic inverter. The logic is inverted to drive a red-light-emitting diode 162 which indicates a fault condition one one of the sensors, using the low output condition as a sink for current from the light emitting diode 162. The output of a transistor-transistor logic device is able to act as a sink (low level) for approximately forty times as much current as it can provide as a source (high level). In this circuit all of the loads, except other gate inputs, are driven using the transistor-transistor logic output as a sink. A resistor 163 limits the light-emitting diode current to an acceptable level.

The power supplies for the circuits 132 and 133 are connected to lead 165 and 166 (+5 volts) and leads 167 and 168 (ground). A capacitor 170 assures supply for surges in power demand during switching.

The gate corresponding to the output 173 performs the inversion function for the signal originating at the second sensor (the lower one of FIG. 8). The resistor 175 and the red light emitting diode 176 in series with such resistor provide indication of a fault (or a previous fault still latched by the logic).

The gate corresponding to the output 180 receives inputs from the two gate outputs which go "low" to indicate a fault (or latched fault) respectively on the two sensors (output 160 and 173. With both of the input signals high, the output 180 is low. Such a non-fault status is indicated by the the green-light-emitting diode 181 which sinks current to the output 180 when it is low. The current for the green-light-emitting diode 181 flows from the supply (see FIG. 7) through a resistor 182 (FIGS. 7) into lead 80 and out of lead 81 of the triac driver 78. The current flows through a light-emitting diode within the triac driver 78 and light from the light-emitting diode triggers the light sensitive triac. The effect is to turn on current to the solenoid 21 controlling the valve 24.

The gate corresponding the output 185 inverts the signal at the output 180 to give a sink which is "low" for any fault condition. The output 185 is connected to the resistor 91 of the circuit shown in FIG. 7 and controls the audible alarm 84.

An example of the operation of the above described circuits follows. Assuming as a starting condition that both sensors are shorted and the switch 124 is in the latch position, the outputs of 100 and 109 of amplifiers 92 and 93 will both be low. The outputs of 139 and 156 of the latch circuits within integrated circuit 132 will both be high. The outputs 160 and 173 of the two inverter gates which invert the latch outputs will both be low, and the two red-light-emitting diodes 162 and 176 will be glowing. The output 180 will be high, and the green light emitting diode 181 will be off. The solenoid valve 24 will be de-energized and the alarm 84 will be sounding (presuming the switch 90 is closed).

If the shorts on the two sensors are removed, there will be no apparent change. The outputs 100 and 109 of the amplifiers will go high, causing the input 137 to also go high, but since the input pin 138 of circuit 132 is held low by the action of the latch circuit, there will be no change in the output 139 which will remain high. The circuit associated with the other sensor will behave in the same manner. The solenoid valve 24 will remain de-energized, the alarm 84 will continue to sound, the red light emitting diodes 162 and 176 will remain on, and the green light emitting diode 181 will remain off.

If the switch 124 is then changed to the reset position (to the right in FIG. 8), the outputs 152 and 142 will go high, and the outputs 139 and 156 will become the inverse of the two amplifier outputs. In such a case, both the latch circuit outputs will go low, the inverter outputs will go high, the two red light emitting diodes 162 and 175 will go out, the green light emitting diode 181 will come on, the alarm 84 will stop sounding and the solenoid valve 24 will be energized.

What is claimed is:

1. In a building having a below-grade basement floor, a floor drain in the basement floor leading to an exterior waste water disposal means, and a water supply line for supplying water to the building, apparatus for detecting the liquid level in the basement floor drain of the building comprising cover meand closing the top of the drain; tubular casing means extending through said cover means into the drain, said casing means having an open bottom end for admitting liquid when the liquid level in the drain rises above a predetermined level; first sensor means extending downwardly into said casing means for contacting by the liquid upon rising above such predetermined level; a drain vent line connected at one end with the cover means and communicating with the upper part of the drain and leading therefrom to communicate with the atmosphere at a location above grade of the building for allowing any air above the rising liquid level to escape via said drain vent line, said location above grade of the building being such that waste water overflow from said waste water disposal means can occur outside the building before the liquid level in said drain vent line reaches the upper end of said drain vent line at said location; and control means connected to said sensor means for shutting off the water supply to the building when the liquid level rises above said predetermined level.

2. An apparatus according to claim 1, wherein said cover means includes removable plug means, permitting draining of liquid into the drain.

3. An apparatus according to claim 1, wherein said first sensor means includes spaced apart first conductor means for extending into said casing means, whereby liquid above the predetermined level closes an electrical circuit between said first conductor means.

4. An apparatus according to claim 1, including coupler means for removably connecting said sensor means to said casing means.

5. An apparatus according to claim 3, including coupler means for removably connecting said sensor means to said casing means.

6. An apparatus according to claim 5, wherein said first sensor means includes sleeve means for carrying said first conductor means in spaced apart relationship extending into the casing means; and cap means incorporating said coupler means for connecting the sensor means to said casing means.

7. Apparatus as claimed in claim 1 wherein said floor drain includes a generally U-shaped trap disposed below said predetermined level, and the lower end of said casing is coupled to an extension tube through which liquid passes to reach said casing and said first sensor means, and said extension tube extends downwardly in the drain beyond the low point of said trap such that the inlet end of the extension tube is above the low point of said trap to minimize the possibility of bubbles entering the tube and forming a foam in said casing.

8. In a building having a below-grade basement floor, a floor drain in the basement floor leading to an exterior waste water disposal means, and a water supply line for supplying water to the building, apparatus for detecting liquid in the basement of the building comprising cover means for closing the top of the floor drain; tubular casing means for extending through said cover means into said drain, said casing means having an open bottom end for admitting liquid when the liquid level in the drain rises above a predetermined level, first sensor means extending downwardly into said casing means for contacting by the liquid upon rising above said predetermined level; a drain vent line connected at one end with the cover means and communicating with the upper part of the drain and leading therefrom to communicate with the atmosphere at a location above grade of the building for allowing any air above the rising liquid level to escape via said drain vent line, said location above grade of the building being such that waste water overflow from said waste water disposal means can occur outside the building before the liquid level in said drain vent line reaches the upper end of said drain vent line at said location; second sensor means for placing on the basement floor for detecting moisture on the floor; control means connected to said first and second sensor means for shutting off the water supply to the building when the liquid level rises above said predetermined level or when said second sensor means senses moisture on the floor.

9. An apparatus according to claim 8, wherein said first sensor means includes spaced apart first conductor means for extending into said casing means, whereby liquid above the predetermined level closes an electrical circuit between said first conductor means.

10. An apparatus according to claim 9, including coupler means for removably connecting said sensor means to said casing means.

11. An apparatus according to claim 10, wherein said first sensor means includes sleeve means for carrying said first conductor means in spaced apart relationship extending into the casing means; and cap means incorporating said coupler means for connecting the sensor means to said casing means.

12. An apparatus according to claim 9, wherein said second sensor means includes non-conductive plate menas for resting on the floor, and spaced apart second conductor means on said plate means, whereby floor moisture closes a circuit between said second conductor means for providing a signal to said control means.

13. An apparatus according to claim 8, wherein said second sensor means includes non-conductive plate means for resting on the floor, and spaced apart second conductor means on said plate means, whereby floor moisture closes a circuit between said second conductor means for providing a signal to said control means.

14. Apparatus as claimed in claim 8 wherein said floor drain includes a generally U-shaped trap disposed below said predetermined level, and the lower end of said casing is coupled to an extension tube through which liquid passes to reach said casing and said first sensor means, and said extension tube extends downwardly in the drain beyond the low point of said trap such that the inlet end of the extension tube is above the low point of said trap to minimize the possibility of bubbles entering the tube and forming a foam in said casing.

15. In a building having a below-grade basement floor, a floor drain in the basement floor leading to an exterior waste water disposal means, a generally U-shaped trap disposed below said floor drain, and a water supply line for supplying water to the building, apparatus for monitoring the liquid level in the basement floor drain of the building comprising cover means for closing the top of the drain, a tubular casing extending through the cover means into the drain, said tubular casing having means for venting any trapped air above the rising liquid level, said tubular casing having an open lower end for admitting liquid, first sensor means extending downwardly into said casing to a predetermined level above said U-shaped trap so as to be contacted by liquid upon rising in said casing to said predetermined level, said casing further including an open ended extension member extending downwardly in the drain beyond the low point of said trap such that the lower inlet end of the casing is above the low point of said trap to minimize the possibility of bubbles entering said open end and forming a foam in said casing which might give a false signal to said sensor means, and control means connected to said sensor means for shutting off the water supply to the building when the liquid level rises above said predetermined level.

* * * * *